US011189446B2

(12) United States Patent
Kechroud et al.

(10) Patent No.: US 11,189,446 B2
(45) Date of Patent: Nov. 30, 2021

(54) UNIVERSAL VACUUM INTERRUPTER FOR AIR DISCONNECT SWITCHES

(71) Applicant: General Electric Technology Gmbh, Baden (CH)

(72) Inventors: Riyad Kechroud, Québec (CA); Clément Rollier, Québec (CA)

(73) Assignee: General Electric Technology Gmbh, Baden (CH)

( * ) Notice: Subject to any disclaimer, the term of this patent is extended or adjusted under 35 U.S.C. 154(b) by 0 days.

(21) Appl. No.: 16/857,010

(22) Filed: Apr. 23, 2020

(65) Prior Publication Data

US 2020/0350130 A1 Nov. 5, 2020

(30) Foreign Application Priority Data

Apr. 30, 2019 (EP) ..... 19172032

(51) Int. Cl.
*H01H 33/664* (2006.01)
*H01H 33/666* (2006.01)

(52) U.S. Cl.
CPC ..... *H01H 33/6664* (2013.01); *H01H 33/664* (2013.01); *H01H 33/6661* (2013.01)

(58) Field of Classification Search
CPC ..... H01H 33/126; H01H 33/128; H01H 33/6664; H01H 33/664; H01H 33/6661; H01H 33/143; H01H 33/73; H01H 33/77; H01H 2033/6667; H01H 31/28; H01H 33/125

(Continued)

(56) References Cited

U.S. PATENT DOCUMENTS 2,810,805 A * 10/1957 Schwager ..... H01H 33/128 218/3
3,171,004 A * 2/1965 Luehring ..... H01H 33/126 218/8

(Continued)

FOREIGN PATENT DOCUMENTS

DE 199 18 077 C1 11/2000
GB 2 551 301 A 12/2017

OTHER PUBLICATIONS

Search Report issued in European Application No. 19 17 2032, dated Oct. 31, 2019, 1 page.

*Primary Examiner* — William A Bolton
(74) *Attorney, Agent, or Firm* — Eversheds Sutherland (US) LLP

(57) ABSTRACT

The invention relates to a universal vacuum interrupter (UVI) (30) for an air disconnect switch (100) comprising a rotatable actuating arm (21) arranged for engagement by a corresponding contact (16), such as a roller, attached to the main blade (12) of an air disconnect switch (100). In particular, the actuating arm (21) comprises two rods (22) extending next to each other and adapted for receiving the corresponding contact (16) of the main blade (12) between them. The two rods (22) are movable to alter the distance between them but are biased together by biasing means (24), e.g. helical springs. As the corresponding contact (16) of a main blade (12) will be in engagement with both rods (22) during disconnection and reconnection of the air disconnect switch (100), arcing is thereby prevented. Preferably, the two rods (22) of the UVI (30) are made of aluminium.

11 Claims, 2 Drawing Sheets

(58) Field of Classification Search
USPC ..... 218/140, 5–10, 12, 20, 43, 45, 79, 80, 218/100; 200/10, 16 F
See application file for complete search history.

(56) References Cited

U.S. PATENT DOCUMENTS

| | | | | | |
|---|---|---|---|---|---|
| 3,824,359 | A * | 7/1974 | Date | H01H 33/127 | 218/10 |
| 4,339,636 | A * | 7/1982 | Cleaveland | H01H 31/023 | 200/48 A |
| 4,591,678 | A * | 5/1986 | Yin | H01H 33/128 | 218/121 |
| 5,635,692 | A * | 6/1997 | Ward, Jr. | H01H 33/168 | 218/146 |
| 5,859,398 | A * | 1/1999 | McKean | H01H 33/128 | 218/10 |
| 8,581,135 | B2 * | 11/2013 | Piccoz | H01H 33/126 | 218/140 |
| 2002/0092741 | A1 * | 7/2002 | Demissy | H01H 31/28 | 200/17 R |

* cited by examiner

UNIVERSAL VACUUM INTERRUPTER FOR AIR DISCONNECT SWITCHES

CROSS-REFERENCE TO RELATED APPLICATIONS

This application claims the priority benefit of European Application No. 19172032.5, filed Apr. 30, 2019, which is incorporated herein by reference.

TECHNICAL FIELD

The invention relates to the field of air disconnect switches for high-voltage substations. More particularly, the invention relates to a universal vacuum interrupter for air disconnect switches for high-voltage substations which reduces arcing during the disconnection and reconnection phases. The invention also relates to a method of disconnecting and reconnecting an air disconnect switch with a universal vacuum interrupter.

PRIOR ART

When air disconnect switches with universal vacuum interrupters (UVI) in high-voltage substations are disconnected, the electric current is passed in parallel through a secondary circuit prior to disconnection of the main blade of the primary circuit. This secondary circuit runs through a UVI, which comprises a hollow insulator with a vacuum interrupter within. It maintains the electrical connection between the two opposing terminals of the air disconnect switch until the primary circuit has fully disconnected, and then safely breaks the secondary circuit in the vacuum interrupter inside the hollow insulator.

In one known air disconnect switch, the secondary circuit is provided in part by an actuating arm, in the form of a single rod, on the UVI and a corresponding contact, in the form of a roller attached to the main blade. The air disconnect switch is arranged such that the movement of the main blade acts to open the secondary circuit. In particular, when the main blade of the primary circuit swings open, the corresponding contact of the main blade rotates the actuating arm of the UVI with which it is engaged. The actuating arm, which is mounted on a rotatable shaft mechanically connected to an interrupter within the UVI, operates the interrupter as a result, opening the secondary circuit and thereby breaking the electric current completely.

Arcing however occurs while the single rod of the actuating arm is engaged with the roller of the main blade during the disconnection phase, and especially so when they move relative to each other. This is undesirable as it can cause damage to the air disconnector switch and may also be dangerous.

As such, there is clearly a need for an air disconnect switch with a UVI which is less susceptible to arcing and safer.

BRIEF DESCRIPTION OF THE INVENTION

The present invention relates to a universal vacuum interrupter (UVI) for an air disconnect switch, the UVI comprising a rotatable actuating arm arranged for engagement by a corresponding contact of a main blade of an air disconnect switch, the actuating arm mounted on a rotatable shaft mechanically connected to an interrupter within the UVI such that rotation of the actuating arm operates the interrupter, wherein the actuating arm comprises two rods extending next to each other and being movable to alter the distance between them, the two rods being adapted for receiving the corresponding contact of the main blade between them, and wherein the actuating arm further comprises biasing means biasing the two rods towards each other, such that both rods will be engaged with the corresponding contact.

The invention also relates to a method of operating an air disconnect switch with a UVI comprising providing the UVI with an actuating arm, mechanically connecting an interrupter within the UVI to a rotatable shaft, mounting the actuating arm on the rotatable shaft such that rotation of the actuating arm operates the interrupter, providing a main blade of the air disconnect switch with a corresponding contact, providing the actuating arm with two rods, and engaging the corresponding contact of the main blade with the actuating arm by biasing the two rods towards one another such that both rods are engaged with the corresponding contact.

Preferable features of the invention are defined in the appendant claims.

BRIEF DESCRIPTION OF THE FIGURES

The invention will be better understood when reading the following detailed description and non-limiting examples, as well as studying the figures, wherein.

In all of these figures, identical references can designate identical or similar elements. In addition, the various portions shown in the figures are not necessarily shown according to a uniform scale, in order to make the figures more legible.

DETAILED DESCRIPTION OF PARTICULAR EMBODIMENTS

Figure 1:
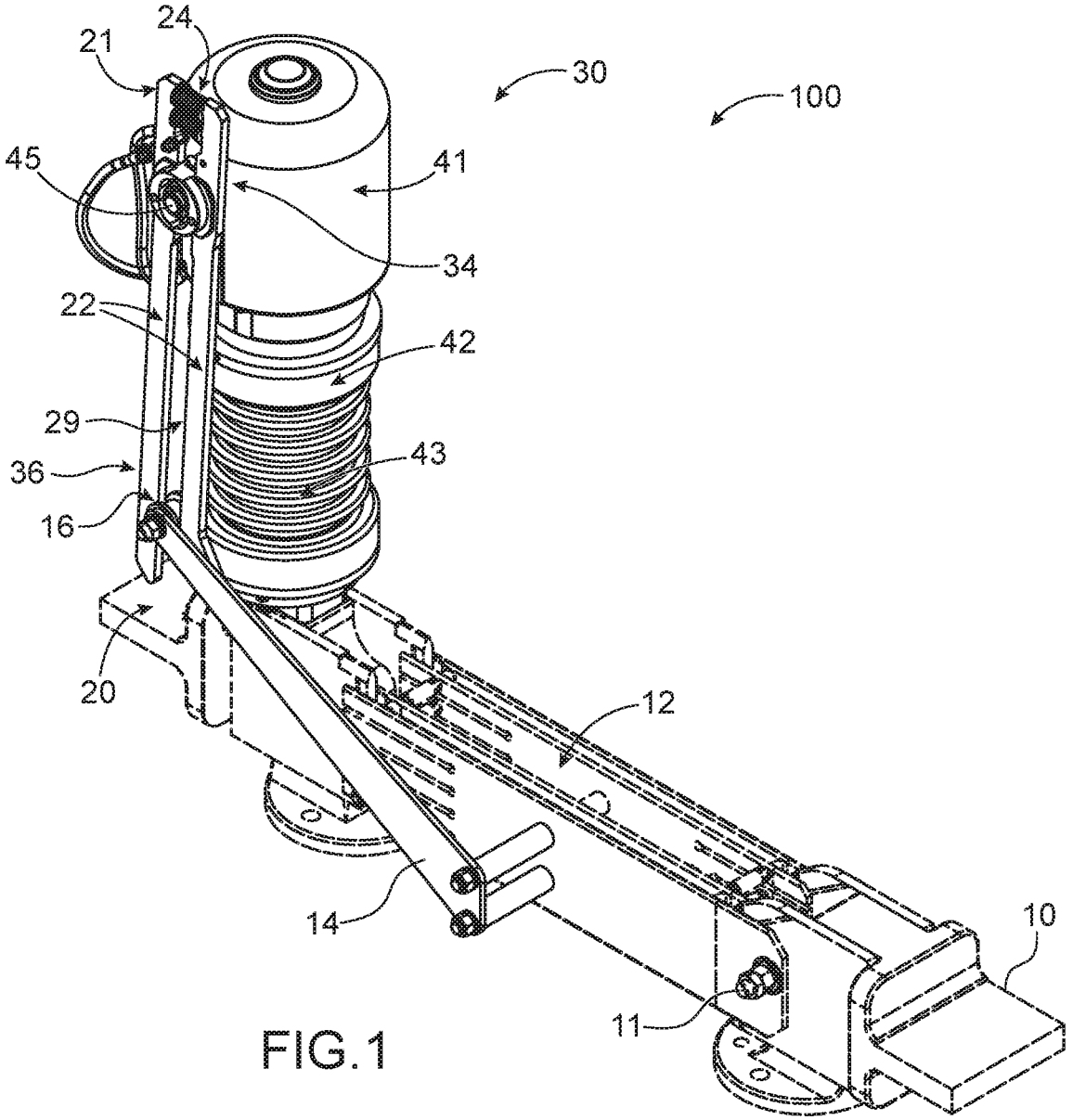
FIG. 1 shows a perspective view of an air disconnect switch with a UVI according to a preferred embodiment of the invention.
Figure 2:
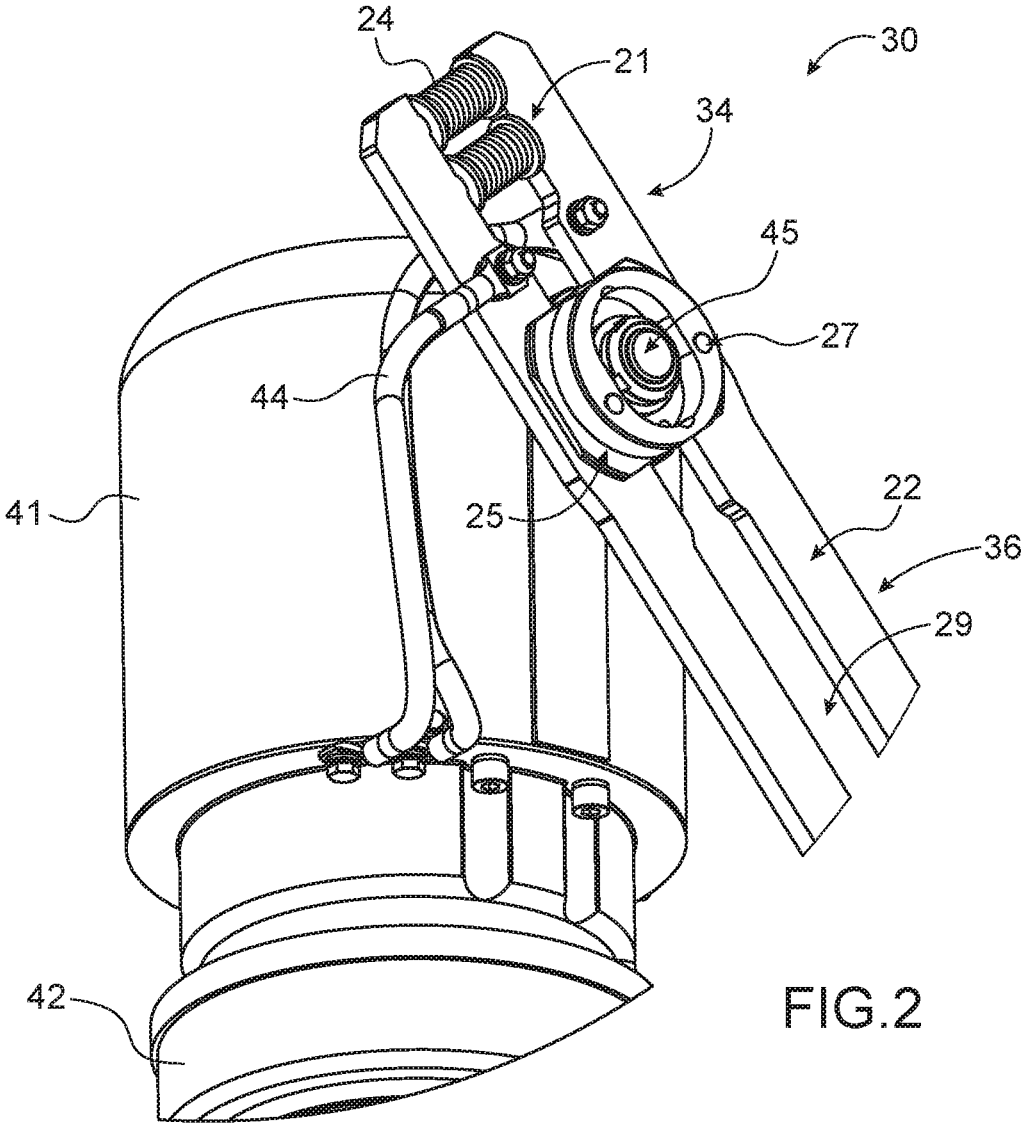
FIG. 2 shows a close-up perspective view of the UVI.
Figure 3:
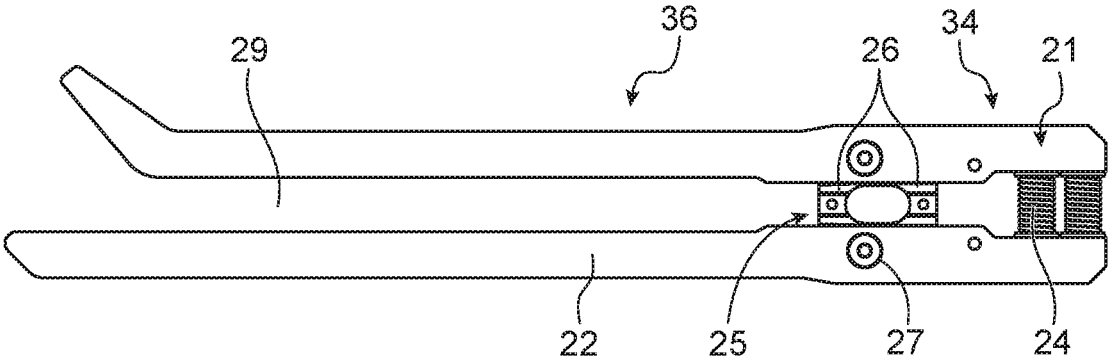
FIG. 3 shows a side view of the actuating arm of the UVI.

FIG. 1 shows an air disconnect switch with a universal vacuum interrupter (UVI) according to a preferred embodiment of the present invention. FIG. 2 shows a close up of the UVI with the actuating arm at a different angular position as that shown in FIG. 1. Meanwhile, FIG. 3 shows a side view of the actuating arm on its own.

The air disconnect switch 100 of the invention comprises two opposing terminals 10, 20 across which the main blade (disconnector) 12 can extend to connect the primary circuit. It is represented in FIG. 1 with the main blade 12 in the closed position. To open the primary circuit, the main blade 12 swings upwards about its pivot 11 to provide the separation between the two opposing terminals 10, 20. The main blade 10 also comprises a bracket arm 14 with a roller 16 at the tip, the two attached to and moving together with the main blade 12. The roller 16 is engaged with the UVI 30. These aspects of the air disconnect switch 100 are generally known.

The UVI 30 is provided on the air disconnect switch 100 such that it sits in its secondary circuit. For the most part, the UVI 30 is of a standard known construction. It comprises an interrupter 43 residing within a hollow insulator 42 of the UVI 30. It also comprises a gear housing 41 adjacent the hollow insulator 42, and a rotatable shaft 45 mounted on the gear housing 41 and mechanically connected to the interrupter 43. The UVI 30 also has actuating arm 21 mounted to the rotatable shaft 45, such that rotation of the actuating arm 21 operates the interrupter 43. The actuating arm 21 and the main blade 12 of the air disconnect switch 100 move in parallel planes. The UVI 30 is provided on the air disconnect switch 100 such that its actuating arm 21 is/can be engaged by a corresponding contact 16 on the main blade 12, in this case the roller 16, to form part of the secondary circuit.

However, the actuating arm 21 of the UVI 30 of the present invention is different to those of known UVIs. In particular, it comprises two rods 22 which extend next to each other. The rods 22 are movable such that the distance between them can be altered, although they are biased towards each other by biasing means 24. This actuating arm 21 is arranged to receive the roller 16 of the main blade 12 in the space 29 between the rods 22 such that the rods 22 are always in engagement with it.

In the preferred embodiment of the invention, the actuating arm 21 comprises a mounting plate 25 which is fixedly attached to the rotatable shaft 45 of the UVI 30. The two rods 22 of the actuating arm 21 are each mounted on respective pivots 27 provided on the mounting plate 25. The pivots 25 are located such that they are generally on diametrically opposite sides of the rotatable shaft 45, and their axes are parallel to that of the rotatable shaft 45. Each rod 22 has a base portion 34 on one side of its pivot 27, and an engagement portion 36 on the other side for engaging the roller 16. The actuating arm 21 is disposed on the rotatable shaft 45 such that the two rods 22 effectively have their base portions 34 on one side of the rotatable shaft 45 and their engagement portions 36 on the other side.

Springs 24, preferably helical springs, are provided between the base portions 34 of the rods 22 to serve as biasing means. The springs 24 push apart the base portions 34 of the rods 22, which in turn causes the engagement portions 36 of the rods 22 to be pushed towards one another. Crucially, when the roller 16 is in the space 29 between the two rods 22, both rods 22 will be pressed against it. The force applied by the biased rods 22 effectively maintains the roller 16 in engagement with both rods 22, whether the roller 16 is stationary or moving in the space 29. Ideally, the two rods 22 are in engagement with the roller 16 from before the main blade 12 disconnects to after the interrupter 43 of the UVI 30 is opened, when the air disconnect switch 100 is in the disconnection phase, and from before the interrupter 43 is closed to after the main blade 12 reconnects, when in the reconnection phase.

The actuating arm 21 is mounted on the rotatable shaft 45 substantially perpendicular thereto, with the two rods 22 located in the same plane. The rods 22 are preferably mounted such that they are parallel when the roller 16 is located in the space 29 between them, although in other variations, they may be mounted so as to be slightly skew towards, or away, from each other.

When the actuating arm 21 is in the neutral position, i.e. the position where the two rods 22 are not engaged with the roller 16, the distance between the two rods 22 is less than the dimension/diameter of the roller 16 of the main blade 12. This is due to the biasing of the springs 24, pushing the engaging portions of the rods 22 towards each other. During operation of the air disconnect switch 100, the actuating arm 21 may find itself in a neutral position, for example, when the main blade 12 is completely open in its maximum position and thus the roller 16 is also disengaged from the two rods 22.

Adjustment means (not shown) may be provided on the actuating arm 21 allowing the distance between the two rods 22 to be decreased or increased when they are in the neutral position. The mounting plate 25 may additionally comprise means restricting the pivoting ranges of the two rods 22 with respect to the mounting plate 25. As an example, these may take the form of raised projections 26 situated in proximity of the pivots 27. Furthermore, the force applied by the two rods 22 on the roller 16 can also be increased or decreased, which may be achieved by changing the number of type of springs 24 at the base portion 34 or the lengths of the base portions 34 and engagement portions 36 of the rods 22. In the preferred embodiment, the rods 22 shown have an engagement portion 36 about five times the length of their base portion 34.

It will be appreciated that different lengths of the actuating arm 21/rods 22 can be provided as required, as well as different proportions of the engagement portion to the base portion. Further, the rods 22 may have varying shapes. As shown in FIG. 3, one of the rods 22 is bent near the tip, widening the space 29 between the two rods 22. This allows the actuating arm 21 to more surely and smoothly receive the roller 16, in particular when the roller 16 is to reengage the actuating arm 21 during the reconnection phase.

The UVI 30 of the invention enables arcing to be prevented during operation of the air disconnect switch 100. In particular, by positively maintaining the two rods 22 in engagement with the roller 16, arcing during the disconnection phase and the reconnection phase of the air disconnect switch 100 can be eliminated. The air disconnect switch 100 having the UVI 30 of the invention is therefore safer and more reliable than those presently available. Furthermore, the absence of arcing implies that the actuating arm 21 is exposed to a reduced temperature. As a result, the use of aluminium for the rods 22 of the actuating arm 21 can be envisaged. While the rods 22 can still be made of copper or steel or other materials traditionally chosen for air disconnect switches applications, aluminium generally has the benefit of being much lighter. The rods 22 may be hollow tubes or of solid construction, as appropriate. Holes may nevertheless be provided on them so as to facilitate cooling.

It should be noted that the presence of two rods 22 also represents an increase in the contact area with the roller 16, as compared to the single rod actuating arm of the prior art, which also reduces the likelihood of arcing. To further improve the engagement between the two, the roller 16 may be provided with a smooth cylindrical surface, possibly with flanges at its sides for centering the two rods 22, while the two rods 22 are ideally each provided with smooth flat surfaces for engaging the roller 16.

A preferred method of operating the air disconnect switch 100 with a universal vacuum interrupter (UVI) 30 described above involves engaging the corresponding contact 16 of the main blade 12 with the actuating arm 21 by biasing the two rods 22 towards one another such that both rods 22 are engaged with the corresponding contact 16. This method may be used to disconnect or reconnect the air disconnect switch 100.

The operation of the air disconnect switch 100 with UVI 30 will now be described so as to facilitate the understanding of the invention. At first, the electric current flows through the primary circuit of the air disconnect switch 100, with the main blade 12 provided on a terminal 10 and being connected to an opposing terminal 20, as indicated in FIG. 1. As the main blade 12 of the primary circuit swings upwards about its pivot 11, the roller 16, which is attached to the main blade by the bracket 14 and which is also in engagement with the actuating arm 21 on the UVI 30, causes the actuating arm 21 to rotate upwards from its approximately vertical position. The roller 16 initially moves, in the space 29 between the two rods 22, towards the rotatable shaft 45 of the UVI 30. The two rods 22 under the bias of the springs 24, are both pressed against and remain in engagement with the roller 16. As such, no arcing occurs.

With continued upward pivoting of the main blade 12, the primary circuit opens, and electric current flows through the secondary circuit only. It goes through a part of main blade 12, the bracket 14, the roller 16 to the actuating arm 21 of the UVI 30, through cables 44, and then through the interrupter 43 in the hollow insulator 42 of the UVI 30. FIG. 2 indicates the approximate angular position of the actuating arm 21 at this stage. The roller 16 is still engaged with and rotating the actuating arm 21, although it is moving away from the rotatable shaft 45 towards the tip of the actuating arm 21 at this point. Again, no arcing occurs as both rods 22 are still in engagement with the roller 16.

Next, the interrupter 43 in the UVI 30 opens, electrically disconnecting the two opposing terminals 10, 20 and breaking the electric current completely. As the swinging main blade 12 approaches its maximum open position, the actuating arm 21 reaches an angular position somewhat above horizontal, and the roller 16 disengages from the two rods 22. As the primary and secondary circuits are now both open, no arcing occurs during the disengagement. The actuating arm 21 assumes its neutral position again, the distance between the biased rods 22 reducing a little with the roller 16 exiting the space 29 between them. It however essentially maintains its angular position, so as to allow subsequent reengagement by the roller 16 of the during the reconnection phase of the operation. For reasons of brevity, the discussion will not go further into detail of the reconnection phase, apart from stating that it essentially entails a reversal of the operation described above.

The UVI 30 and air disconnect switch 100 of the present invention represents a significant improvement over the prior art. By biasing the two rods towards one another, they maintain engagement with the corresponding contact when electric current is flowing through them, and thus do not separate to cause arcing like in the prior art. The presence of two rods also has the advantage of an increased contact area with the corresponding contact. Not only that, it facilitates reliable operation of the air disconnect switch in the disconnection phase, and in the reconnection phase.

It will be appreciated that the UVI of the invention can be used in air disconnect switches in different orientations and set-ups. For example, the main blade of an air disconnect switch and the actuating arm of the UVI may move in different planes, e.g. perpendicular planes, such as with a double-motion vertical air disconnect switch. Also, the corresponding contact may not necessarily be a roller, but may take the form of a bar extending from the main blade. The use of the UVI of the invention can be envisaged in such air disconnect switches so long as a corresponding contact on the main blade of the air disconnect switch is able to engage and move the actuating arm of the UVI.

The invention claimed is:

1. A universal vacuum interrupter (UVI) for an air disconnect switch comprising:

a rotatable actuating arm arranged for engagement by a corresponding contact of a main blade of the air disconnect switch, the actuating arm mounted on a rotatable shaft mechanically connected to an interrupter within the UVI such that rotation of the actuating arm operates the interrupter, wherein the actuating arm comprises two rods extending next to each other and being movable to alter a distance between the two rods, the two rods adapted for receiving the corresponding contact of the main blade between the two rods, wherein the actuating arm further comprises biasing means biasing the two rods towards each other, such that both rods will be engaged with the corresponding contact, and wherein the corresponding contact is a roller attached with a bracket, to the main blade of the air disconnect switch, the roller arranged for engaging the actuating arm of the UVI.

2. The UVI according to claim 1, wherein the two rods are each pivotally mounted.

3. The UVI according to claim 2, wherein the actuating arm comprises a mounting plate attached to the rotatable shaft, and the two rods are mounted on respective pivots on the mounting plate located on opposite sides of the rotatable shaft.

4. The UVI according to claim 3, wherein the mounting plate comprises projections restricting pivoting ranges of the two rods.

5. The UVI according to claim 1, wherein the two rods are arranged to move in a first plane.

6. The UVI according to claim 1, wherein the actuating arm is disposed on the rotatable shaft such that the rods each comprise a base portion located on one side of the rotatable shaft, and an engagement portion located on the other side, the biasing means being located between the base portions of the rods.

7. The UVI according to claim 1, wherein the biasing means comprises helical springs.

8. The UVI according to claim 1, wherein the distance between the two rods in neutral positions may be increased or decreased.

9. The UVI according to claim 1, wherein the two rods are made of aluminum.

10. The UVI according to claim 1, wherein in neutral positions, the distance between the two rods is less than a dimension of the corresponding contact.

11. A method of operating an air disconnect switch with a universal vacuum interrupter comprising:

providing the UVI with an actuating arm, mechanically connecting an interrupter within the UVI to a rotatable shaft, mounting the actuating arm on the rotatable shaft such that rotating the actuating arm operates the interrupter, providing a main blade of the air disconnect switch with a corresponding contact for engaging the actuating arm of the UVI, providing the actuating arm with two rods, and engaging the corresponding contact of the main blade with the actuating arm by biasing the two rods towards one another such that both rods are engaged with the corresponding contact, and wherein the corresponding contact is a roller attached with a bracket, to the main blade of the air disconnect switch, the roller arranged for engaging the actuating arm of the UVI.

* * * * *